US008672372B2

(12) United States Patent
Dan

(10) Patent No.: US 8,672,372 B2
(45) Date of Patent: Mar. 18, 2014

(54) REINFORCED BLOWN FILM BAG

(76) Inventor: Gabriel Dan, Mill Valley, CA (US)

( * ) Notice: Subject to any disclaimer, the term of this patent is extended or adjusted under 35 U.S.C. 154(b) by 0 days.

(21) Appl. No.: 13/035,763

(22) Filed: Feb. 25, 2011

(65) Prior Publication Data

US 2011/0210571 A1 Sep. 1, 2011

Related U.S. Application Data

(60) Provisional application No. 61/339,014, filed on Feb. 26, 2010.

(51) Int. Cl.
*A01K 29/00* (2006.01)
*E01H 1/12* (2006.01)

(52) U.S. Cl.
USPC ..... 294/1.3; 294/25

(58) Field of Classification Search
USPC ..... 294/1.3, 25; 2/160, 161.6, 161.8; 383/4; 15/227
See application file for complete search history.

(56) References Cited

U.S. PATENT DOCUMENTS

| | | | | | |
|---|---|---|---|---|---|
| 4,132,442 | A * | 1/1979 | Larsson | 294/1.3 |
| 4,768,818 | A * | 9/1988 | Kolic | 294/1.3 |
| 4,964,188 | A * | 10/1990 | Olson | 15/227 |
| 5,149,159 | A * | 9/1992 | Bardes | 294/1.3 |
| 5,222,777 | A | 6/1993 | Clonch | |
| 5,725,268 | A | 3/1998 | Besasie | |
| 5,836,629 | A * | 11/1998 | Hobart | 294/1.3 |
| 6,116,668 | A | 9/2000 | Carpol | |
| 6,832,796 | B1 * | 12/2004 | Minassians | 294/1.3 |
| 7,976,083 | B2 * | 7/2011 | Black et al. | 294/1.3 |
| 2002/0043810 | A1 | 4/2002 | Dooley | |
| 2005/0052037 | A1 | 3/2005 | Spuck | |

* cited by examiner

*Primary Examiner* — Dean Kramer
(74) *Attorney, Agent, or Firm* — Aka Chan LLP

(57) ABSTRACT

A reinforced blown film bag for minimizing the touch and feel of waste matter collecting experience at the collector hands and for creating fast, clean, efficient, easy and touchless feel of pet waste matter collection and disposal is disclosed herein. The reinforced blown film bag includes fingers pockets, reinforced surface, pet waste matter collecting pocket, pull remove and tie flaps, easy to carry handles ambidextrous use and in some embodiments may be a flat folded bag to portable packaging.

20 Claims, 18 Drawing Sheets

FIG. 7.1
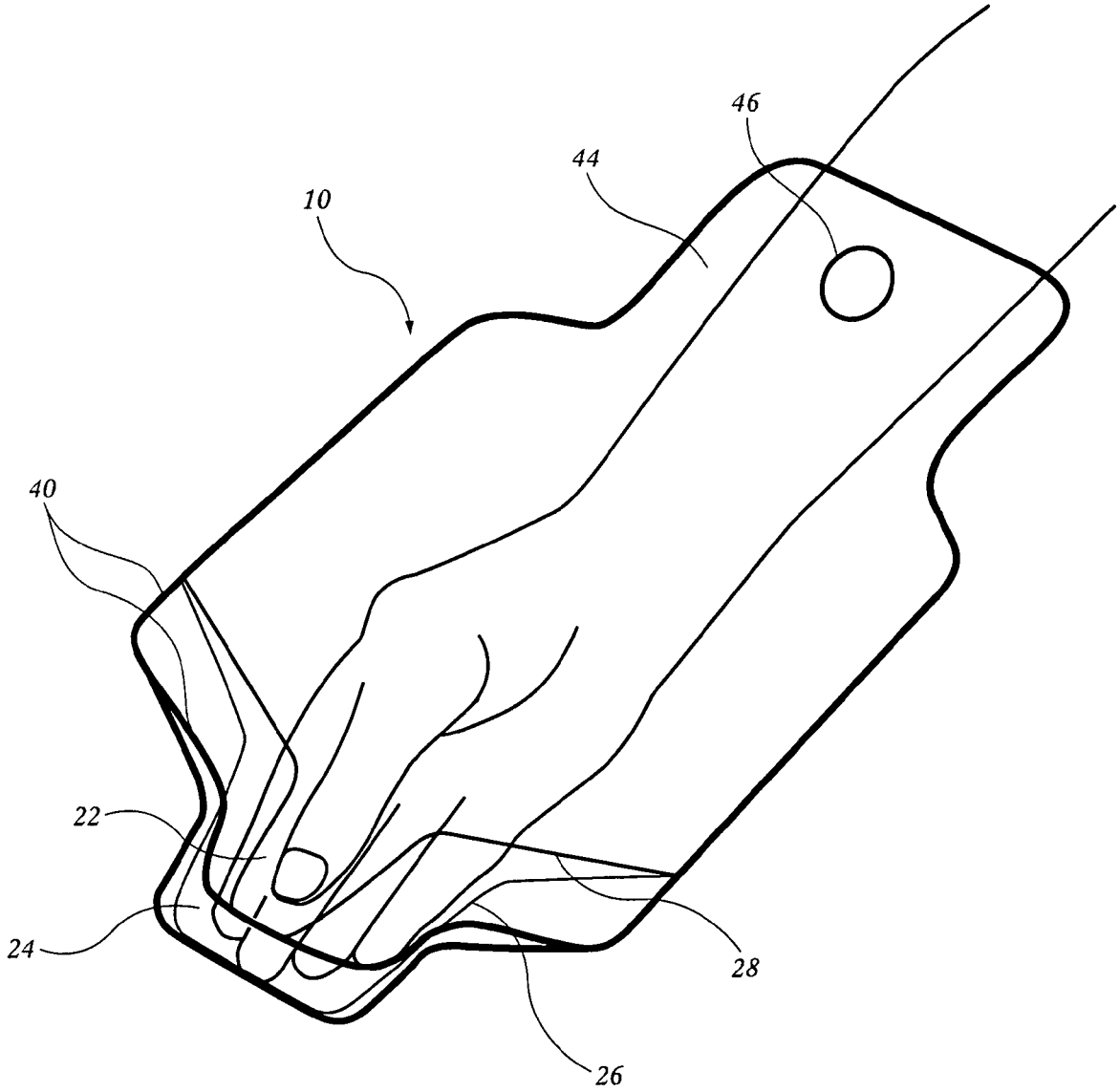

FIG. 7.2
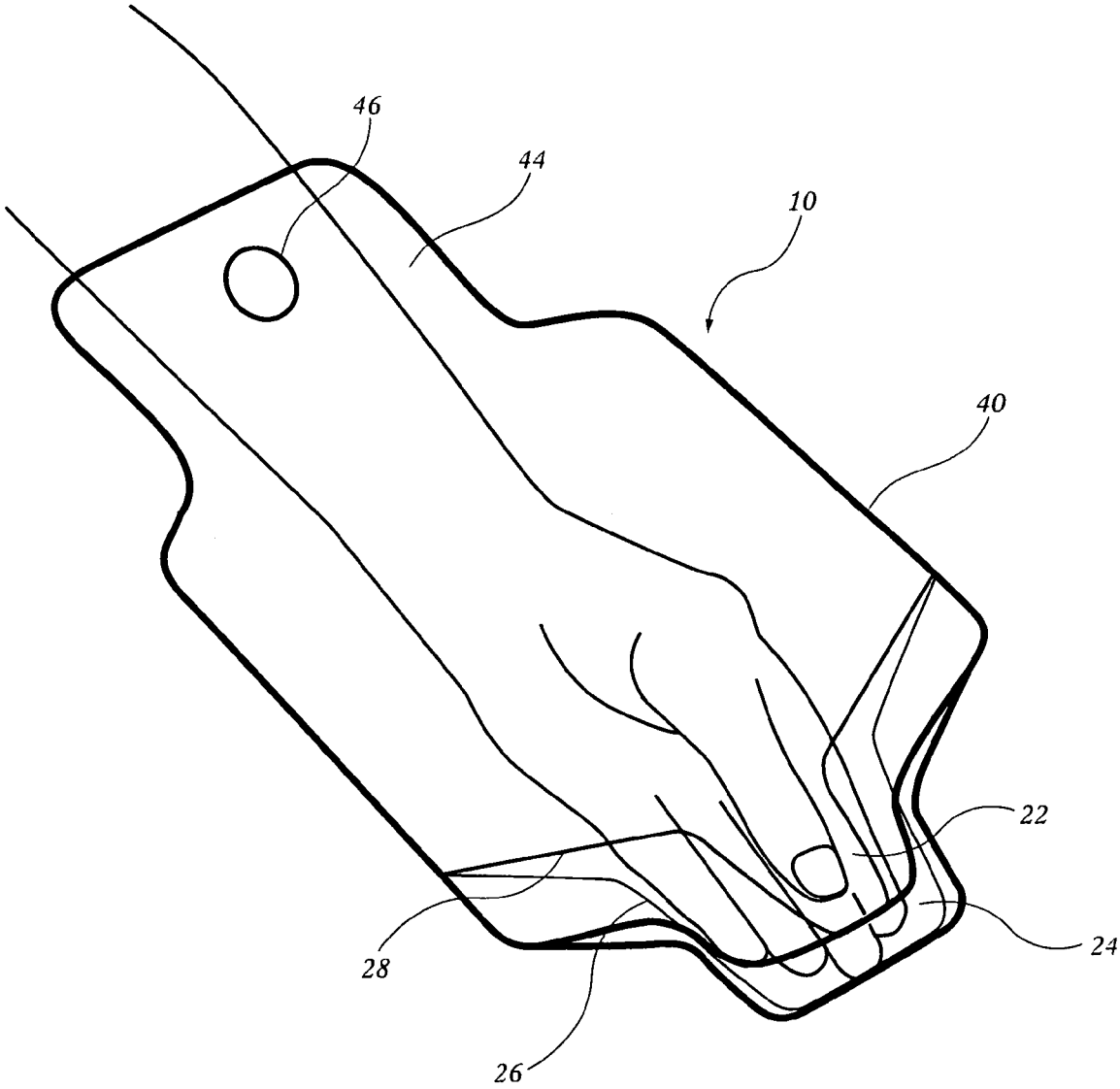

REINFORCED BLOWN FILM BAG

CROSS-REFERENCE TO RELATED APPLICATIONS

This patent application claims the benefit of U.S. provisional patent application 61/339,014, filed Feb. 26, 2010, which is incorporated by reference along with all other cited references in this application.

BACKGROUND OF THE INVENTION

The present invention relates to blown film extrusion products and more specifically a reinforced blown film extruded bag for minimizing the touch and feel of pet waste matter during collection. The present invention allows for a fast, clean, efficient, easy, and touch-less feel of pet waste matter collecting, and easy carrying and disposal of the waste matter.

BRIEF SUMMARY OF THE INVENTION

The invention generally relates to a blown film extruded flat folded bag which includes fingers pockets, reinforced members, a pet waste matter collecting pocket, pull remove and tie flaps, suitability for ambidextrous use, and dedicated handle holes.

There has thus been outlined, rather broadly, some of the features of the invention in order that the detailed description thereof may be better understood, and in order that the present contribution to the art may be better appreciated. There are additional features of the invention described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

One objective of the device is to provide a reinforced blown film extruded bag which may minimizes the touch and feel of pet waste matter collecting experience at the collector hands and creating fast, clean, efficient, easy to carry and touch-less feel of pet waste matter collecting and disposing.

Another object is to provide a reinforced blown film extruded bag that may minimize the feel or touch of the temperature sensation, plasticity, textural and tactile touch and feel of pet waste at the hand of the collector while his/hers hand are inside the bag during the action of pet waste collecting.

Another object is to provide a reinforced blown film extruded bag that may have a dedicated pocket that contains the pet waste at the operation of waste collecting and creates a quick, clean effective pickup and an additional barrier between the collectors hand and the pet waste.

Another object is to provide a reinforced blown film extruded bag that may have an attached reinforced member comprised of a layer of thicker and harder material at the dedicated waste collecting pocket surface that provides an additional barrier between the hand of the pet waste collector and the waste itself. The barrier shape, texture and materials help provide an effective, controlled, clean and quick waste matter collection.

Another object is to provide folding lines on the reinforced member to possibly ease the accommodation of the fingers in the pockets and create yet another protection for fingers.

Another object is to provide a reinforced blown film extruded bag that may have a dedicated finger pocket for the thumb at the closed end of the bag. The finger pocket provides maximum thumb control movement for fast, controlled, clean and easy pet waste matter collection.

Another object is to provide a reinforced blown film extruded bag that may have a second finger pocket for the rest of the four fingers at the closed end of the bag, at the opposite side from the thumb pocket. The finger pockets provide a maximum hand control movement on the four grouped fingers for quick, clean, efficient and easy pet waste matter collection.

Another object is to provide a reinforced blown film extruded bag in which both finger pockets may have a tapered shape to guide the fingers easily into the pockets, have a snug fit and to allow an easy and quick removal of the bag off the hand when needed.

Another object is to provide a reinforced blown film extruded bag in which bot finger pockets may be constructed in such a way they form a strong seam, where seal and connection is obtained to provide adequate strength to the finger pockets.

Another object is to provide a reinforced blown film extruded bag that may have two flaps to pull the reinforced bag when inserting the fingers into their pockets.

Another object is to provide a reinforced blown film extruded bag that may have two flaps to remove the bag and to help pull the hand out of the bag when waste collection is complete.

Another object is to provide a reinforced blown film extruded bag that may be an ambidextrous glove-like tool; it is designed with symmetry for a use by either the right or left handed.

Another object is to provide a reinforced blown film extruded bag that may have two easy to tie flaps for reducing smell, secure clean and easy carrying and disposing.

Another object is to provide a reinforced blown film bag that may have two easy to carry handles in the upper opened part of the bag.

Another object is to provide a reinforced blown film extruded bag that may be but not limited to be folded flat bag and contained in an easy to carry packaging.

Another object is to provide a reinforced blown film extruded bag that may be folded flat and with packaging which provides an opening that allows for easy access in order to pull out the bags independently of each other.

In an implementation, a glove or mitten includes: a first pocket designed to receive four fingers of a user; a second pocket designed to receive a thumb of the user, a sleeve portion designed to cover a hand of the user, where the first and second pockets open to the sleeve portion; a first reinforcing member, connected (such as by heat sealing, adhesive, glue, paste, and other adhesive techniques without puncturing the glove material) to a first exterior surface of the first pocket, where the first reinforcing member comprises at least a portion having a first straight edge, and the first straight edge is positioned distal to a tip of the first pocket; a second reinforcing member, connected to a second exterior surface of the second pocket, wherein the second reinforcing member comprises at least a portion having a second straight edge, and the second straight edge has a length greater a width of the second pocket; and the first and second reinforcing members face each other and the first and second straight edges are approximately parallel to each other.

The first pocket, second pocket, and sleeve portion can be made using a blown film extrusion. This material is inexpensive, making the glove disposable after use (such as after picking up animal waste such as feces, droppings, dung, and manure). The first reinforcing member and second reinforcing member may be made from a rigid material having greater stiffness than the blown film extrusion. For example, the first reinforcing member and second reinforcing member can be card stock. The stiffness of the material can vary based on its thickness (e.g., 0.2 to 1 millimeter, 0.2 to 1.5 millimeters, or 0.2 to 2 millimeters).

Further, a distance from a tip of the first pocket to a bottom of the first pocket is at least 10 millimeters (or greater than 8 millimeters, 9 millimeters, 11 millimeters, or 12 millimeters). In a specific implementation this distance is 12.5 millimeters, which corresponds to a size of a pocket that is formed by the two pockets when grasping something (e.g., dog droppings). The larger the pocket, the more the pocket can hold.

The card stock can include an embossed, texture patterning. This will help grip the animal waste, so it does not easily slip off (such as compared to a standard plastic bag). The texture may also be done by printing, such as printing on the inside of the bag in the pockets (which give the fingers some grip).

The second straight edge of the second reinforcing member is positioned at a distal end of the second pocket. This straight edge allows easy scooping of animal waste, and is positioned ahead of the pocket so the edge does the scooping (and the person will not feel the animal waste through the plastic pocket).

The first pocket, second pocket, and sleeve portion are made using a blown film extrusion; the first reinforcing member and second reinforcing member includes a rigid material having greater stiffness than the blown film extrusion; and first and second openings, positioned at a proximal end of the sleeve portion. The first straight edge of the first reinforcing member has a thickness of about 0.2 millimeters to about 1 millimeter. A width of the sleeve portion is greater than a width of the first pocket. The sleeve portion includes a first sleeve portion having a first width greater than that of a second sleeve portion, the second sleeve portion being proximal to the first sleeve portion.

The second pocket is centered or approximately centered laterally below the first pocket. This allows for ambidextrous use of the glove. The glove can be made from plastic material to which scenting (e.g., floral, linen, perfume, evergreen, citrus, lemon, lime, chocolate, food, or other fresh or pleasant scents) has been applied.

In an implementation, a method of making a glove or mitten includes: providing a blown film extrusion material including plastic; with the blown film extrusion material, forming a first pocket to receive four fingers of a user; with the blown film extrusion material, forming a second pocket to receive a thumb of the user; adhering a first reinforcing member to an exterior surface of the first pocket, the first reinforcing member having a greater stiffness than the blown film extrusion material and having a first straight edge; and adhering a second reinforcing member to an exterior surface of the second pocket, the second reinforcing member having a greater stiffness than the blown film extrusion material and having a second straight edge.

The method further includes packaging the glove including folding the glove so the first and second reinforcing members face each other, the first and second straight edges are approximately parallel to each other, and centering the second pocket below the first pocket. A distance from a tip of the first pocket to a bottom of the first pocket is at least 10 millimeters (e.g., about 12.5 millimeters, 8 or more millimeters, 9 or more millimeters, 11 or more millimeters, and others).

The blown film extrusion material is provided in a folded tubular form, which has a first layer and a second layer beneath the first layer, and the with the blown film extrusion material, forming a first pocket to receive four fingers of a user includes: folding the first layer to form a third layer between the first and second layers; and fusing (e.g., using heat) and cutting the third layer to form the first pocket. With the blown film extrusion material, forming a second pocket to receive a thumb of the user includes: folding the second layer to from a fourth layer between the second and third layers; and fusing and cutting the fourth layer to form the second pocket.

In an implementation, a device includes: a plastic bag, including an interior surface and exterior surface, and a first portion adapted to receive four fingers of a user and second portion adapted to receive a thumb of the user, where the first and second portions of the plastic bag provide a moisture-proof barrier for the users' fingers and thumb; a first stiffening material is connected to an exterior surface of the first portion, and a second stiffening material is connected to an exterior surface of the second portion; where the first and second stiffening material are oriented with respect to each other to facilitate scooping of animal waste material, and the stiffening material reduces heat conduction of the animal waste material to the fingers and thumb compared to using a plastic bag without the first and second stiffening materials.

The plastic bag is made of a flexible material such that after scooping animal waste material, the plastic bag can be flipped over so the exterior surface becomes an interior surface of the flipped plastic bag and the animal waste material and first and second stiffening materials are inside the flipped plastic bag.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

For the purposes of this document the term "reinforced blown film extruded bag" could be also but not only mentioned as the "pick-up bag."

For the purposes of this document the term "pet waste collecting pocket" could be also but not only named as the "collecting compartment."

Figure 1:
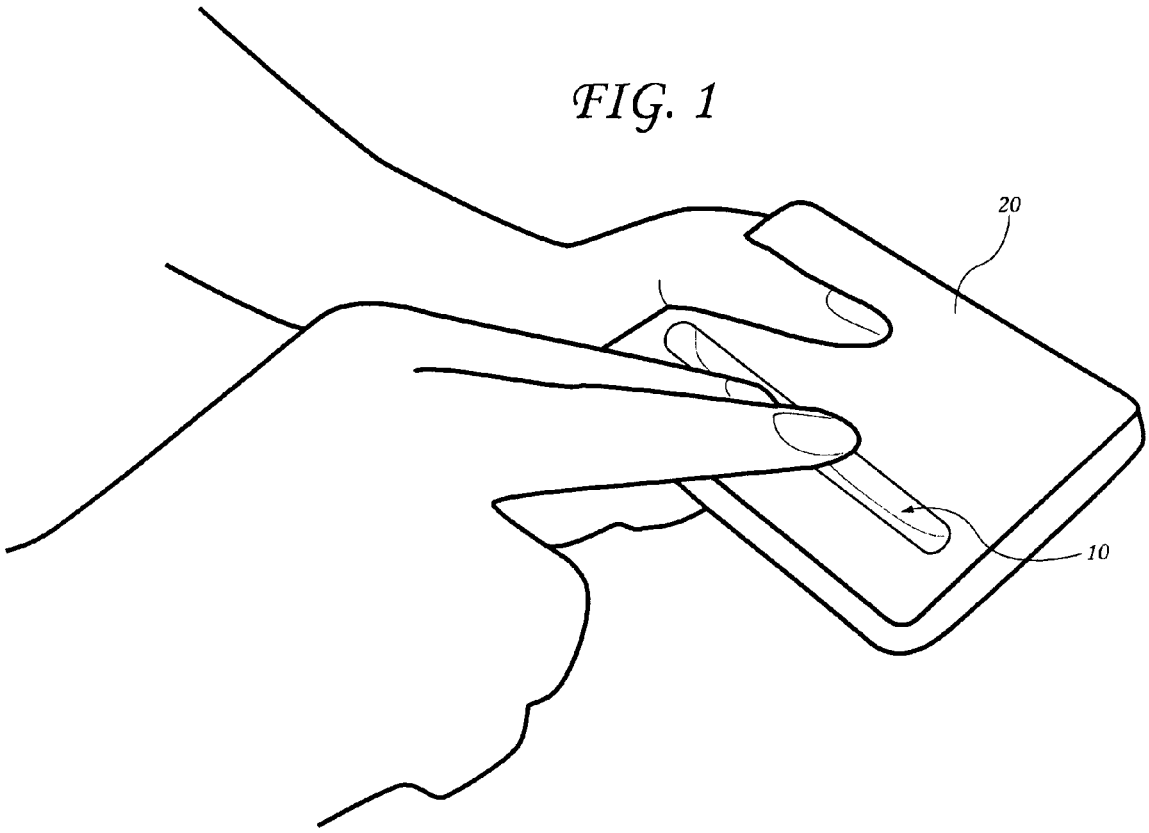

Various other objects, features and attendant advantages of the present invention will become fully appreciated as the same becomes better understood when considered in conjunction with the accompanying drawings, in which like reference characters designate the same or similar parts throughout the several views, and wherein:

FIG. 1: A perspective view of the present invention illustrates the possible but not limited to flat packaging and the possibly quick access to the folded pick-up bag from the bags collective packaging.

Figure 2:
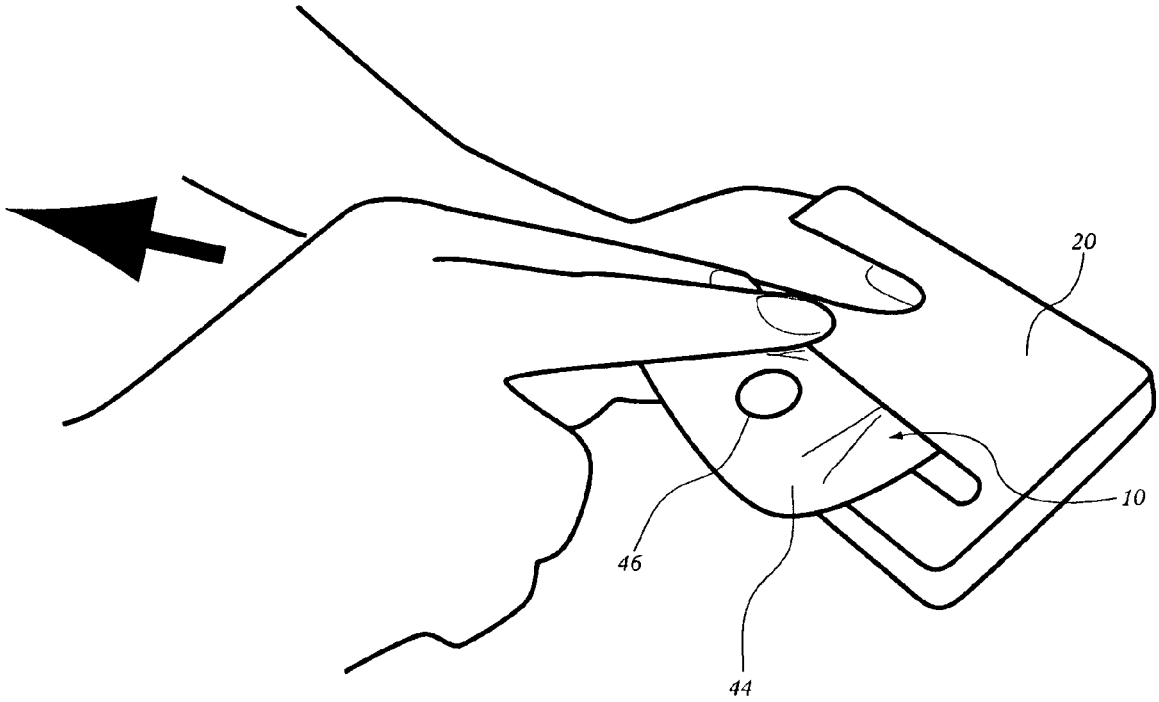

FIG. 2: Yet another perspective view of the present invention illustrates pulling pick-up bag from the possible bags' collective packaging.

Figure 3:
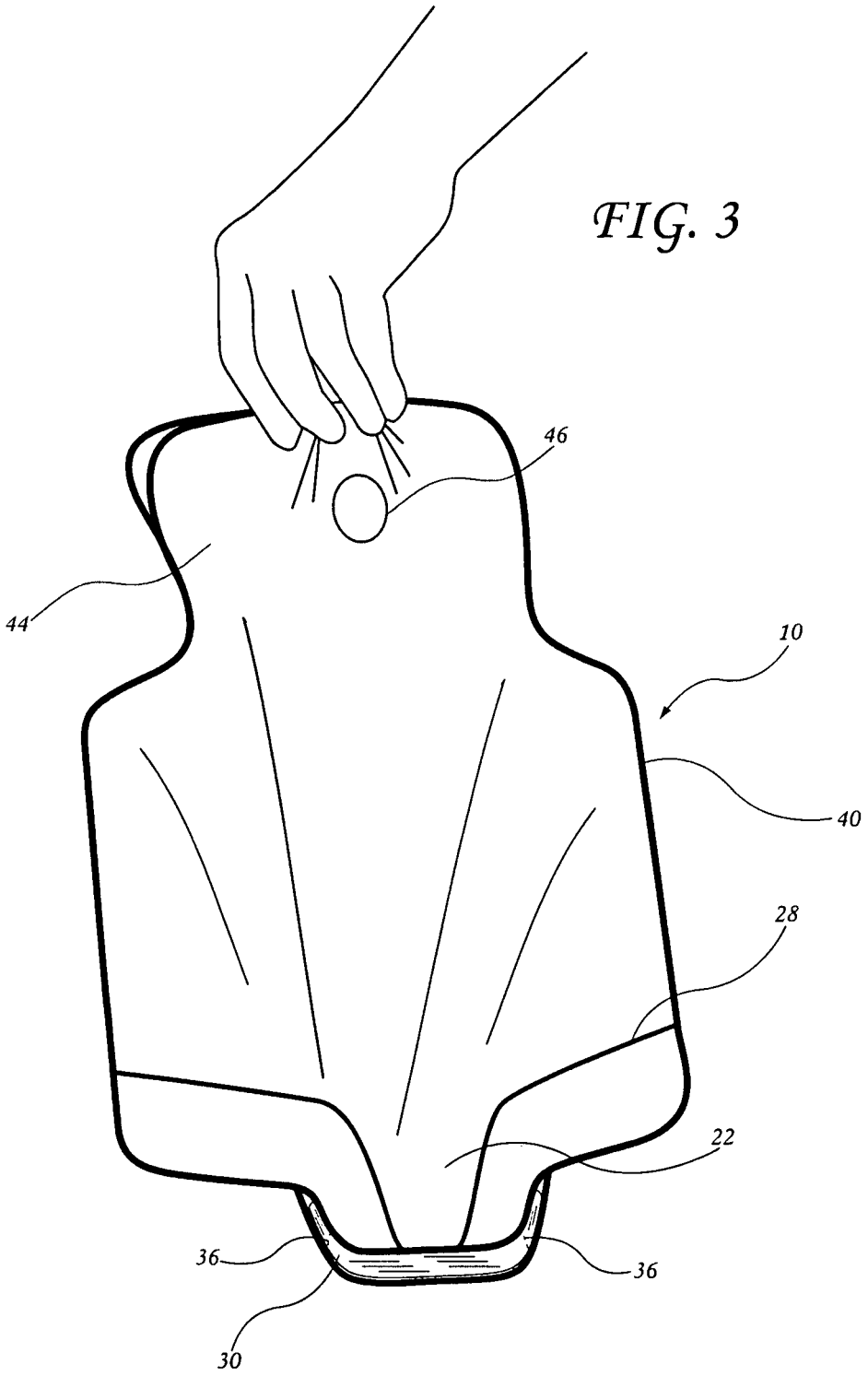

FIG. 3: A further perspective view of the present invention. The reinforced pick-up bag pulled out from its collective packaging with the pick-up bag opening edge in hand.

Figure 4:
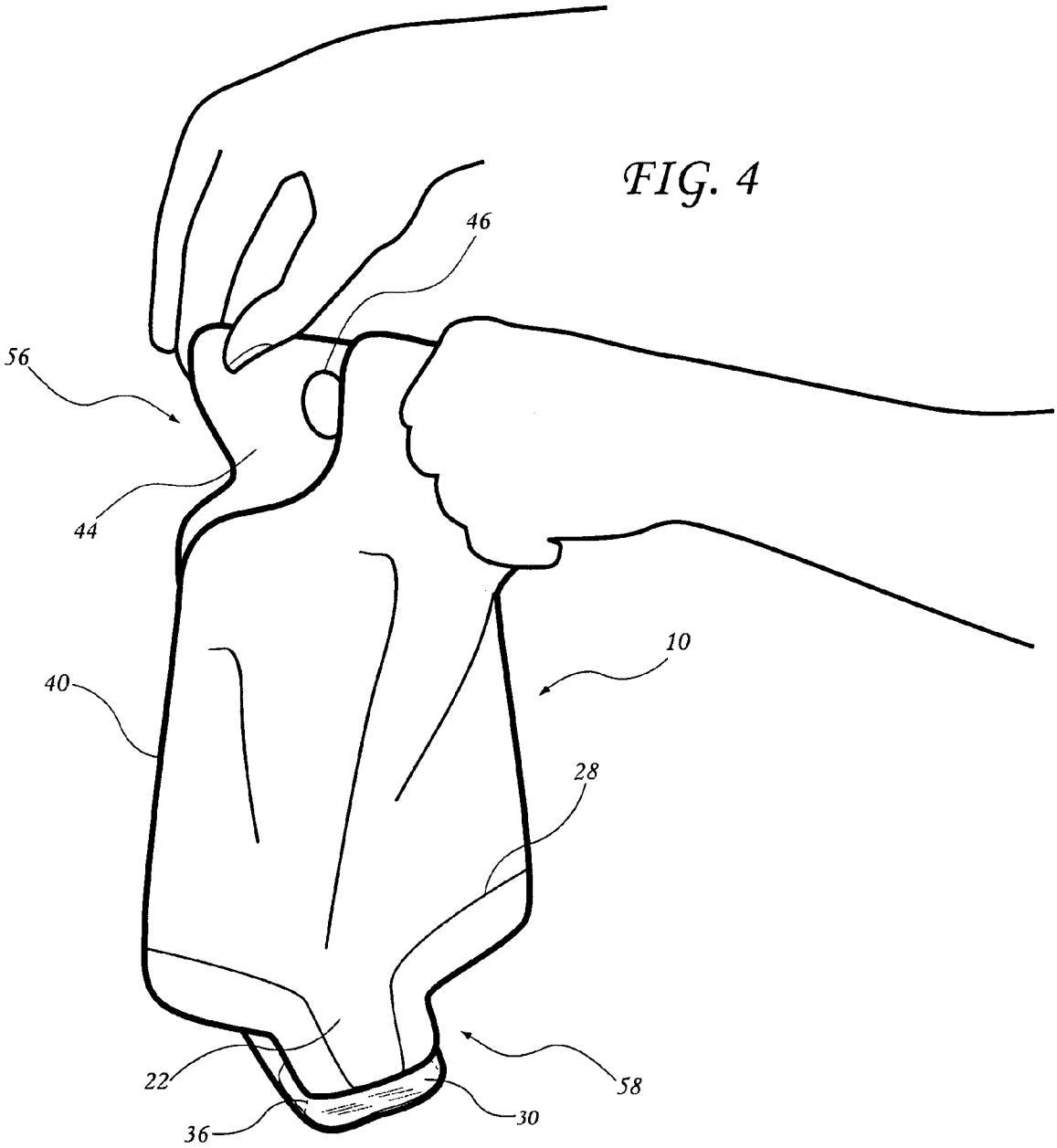

FIG. 4: Yet another perspective view of the present invention illustrates the open bag edge that indicates the direction of the inserted hand into the pick-up bag.

Figure 5:
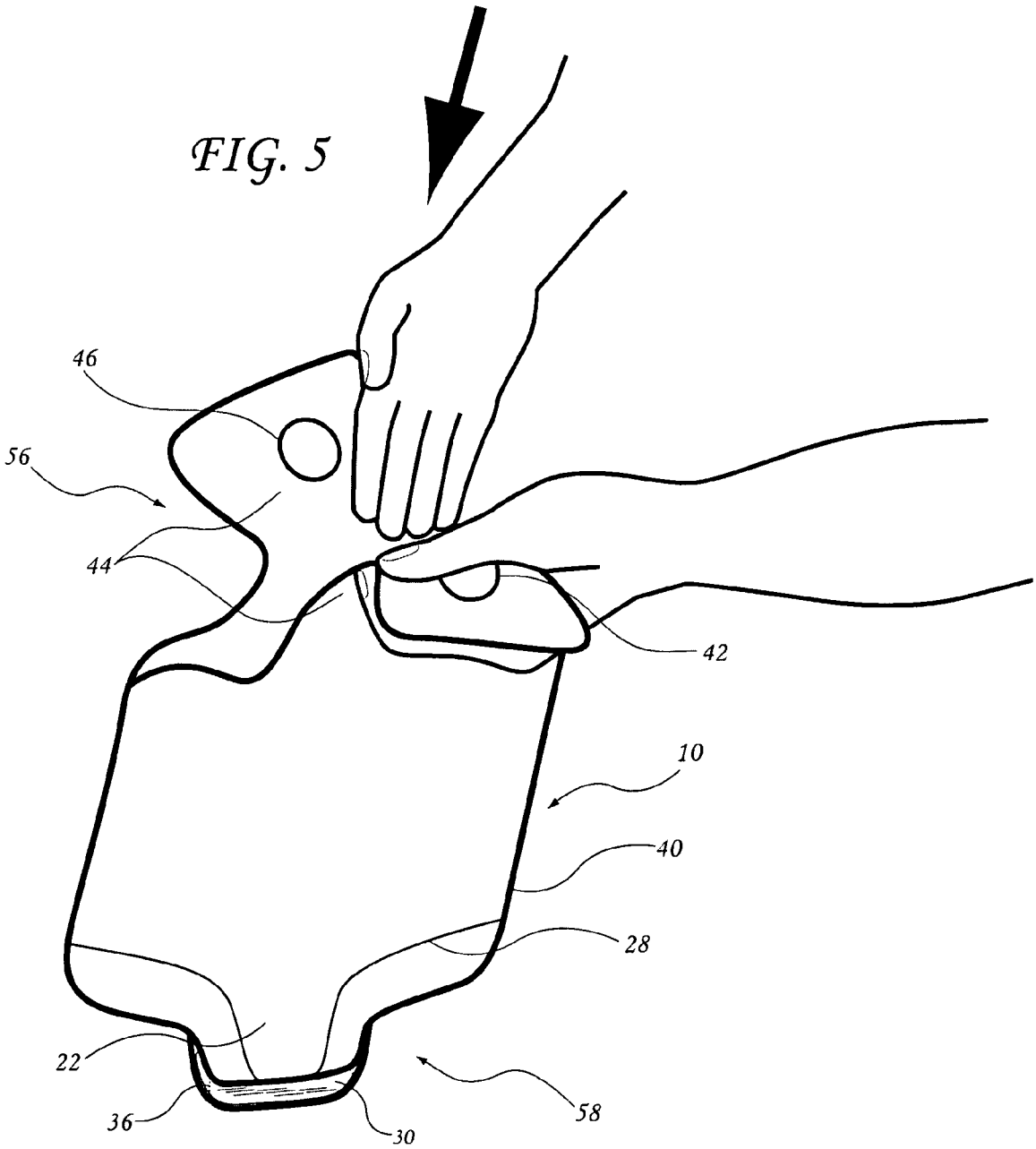

FIG. 5: A further perspective view of the present invention. One hand may be inserted in the bag, other hand may be helping, pulling one of the two designated flaps, for an easy and quick hand insertion into the dedicated finger pockets creates a possible snug fingers fit.

Figure 6:
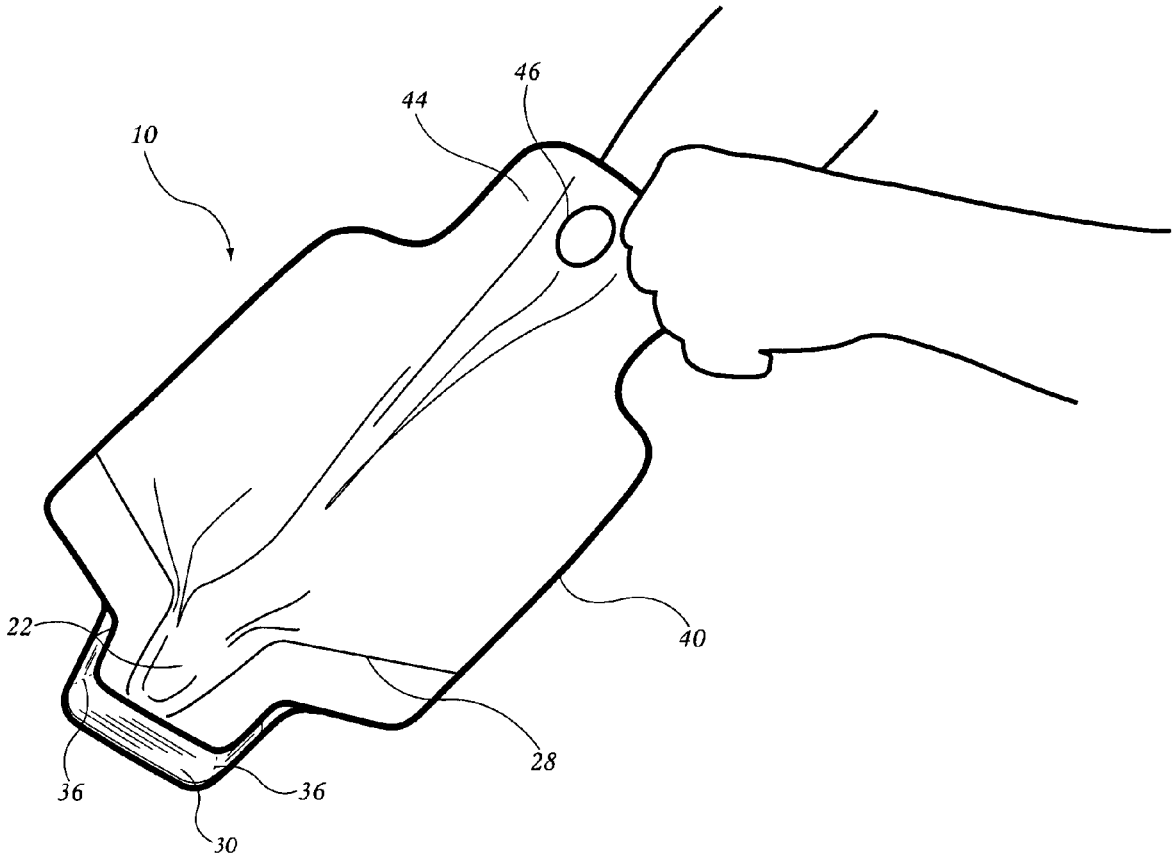

FIG. 6: A further perspective view of the present invention. One hand may be inserted in the bag, other hand may be helping, pulling one of the two designated flaps, for an easy and quick hand insertion into the dedicated finger pockets creates a possible snug fingers fit.

FIG. 7.1: Yet another perspective view of the present invention illustrates the dedicated finger pockets and the designated application of strong heat seal that connects two layers of the bag's film creating the two different finger pockets. Both pockets are purposefully designed to have a tapered shape to guide the fingers quickly into finger pockets and create a snug fit for the fingers and a quick, clean and effective collection. The tapered shaped pockets also create an easy removal of the pick-up bag from the hand. One pocket is provided for the thumb and a second designated pocket is provided on the opposite side of the bag for the fingers. This condition of two pockets creates a purposefully designed waste matter collecting pocket at the lower closed edge of the bag to easily contain pet waste matter. The pick-up bag is purposefully well designed as an ambidextrous device and can be used for a right or a left handed user. FIG. 5.1 illustrates the use of the right hand.

FIG. 7.2: Yet another perspective view of the present invention illustrates the reinforced pick-up bag purposefully designed as an ambidextrous instrument for the use of a right and left hands user. FIG. 5.2 illustrates the use of the left hand.

Figure 8:
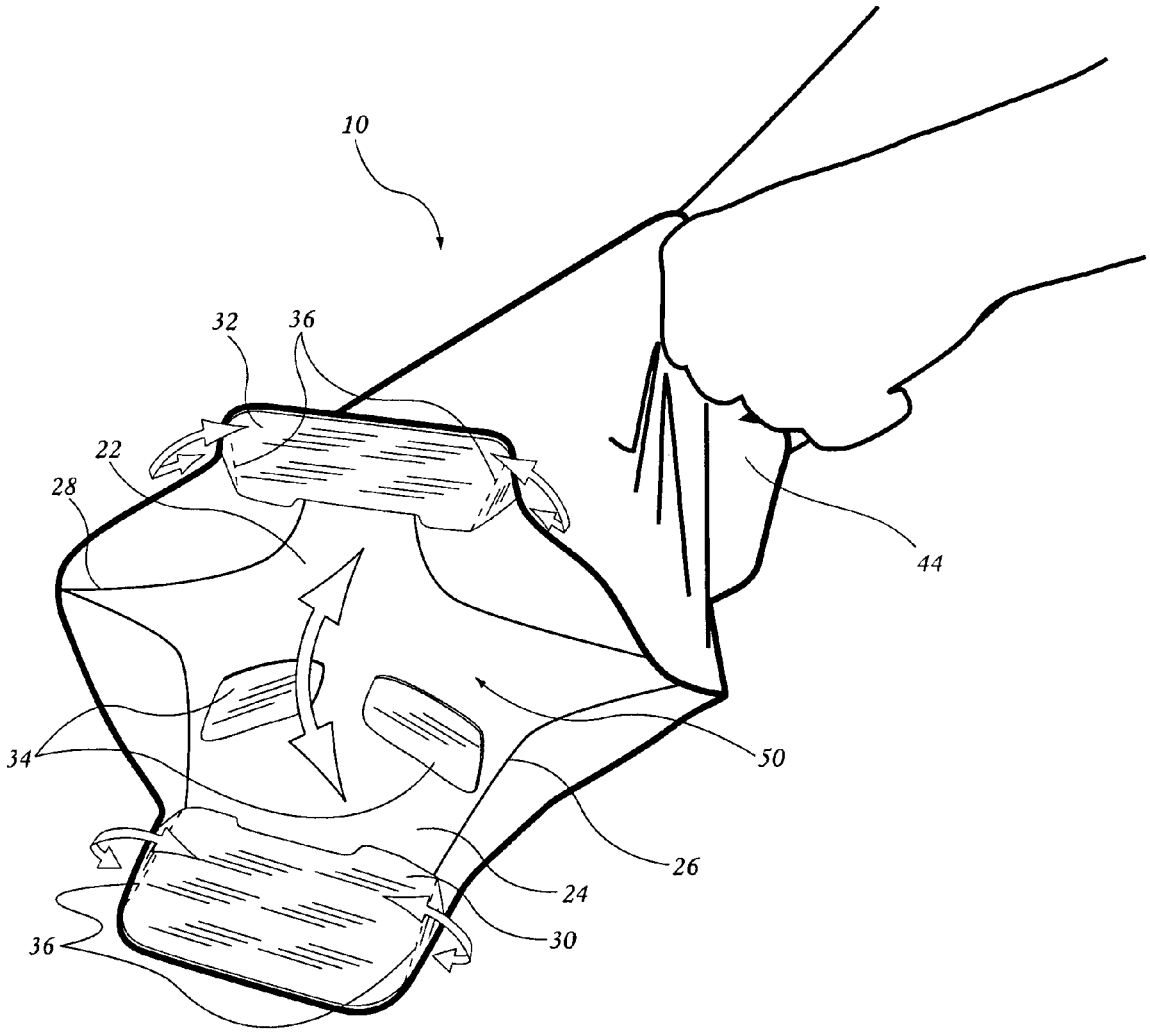

FIG. 8: Yet another perspective view of the present invention illustrates the collecting pocket and the possible reinforced members at the pet waste matter collecting pocket. The designated reinforced member may be applied at the position of the thumb, the four other fingers and the hand pads, for the purpose of minimizing the touch and feel of the pet waste matter heat, its texture and consistency. The reinforced member applied on the exterior surface of the collecting pocket provides a comprehensive hand control fine motor operation for a quick and efficient pick-up, and being able to collect easily multiple number of pet waste matters pieces in different locations using the same bag.

Figure 9:
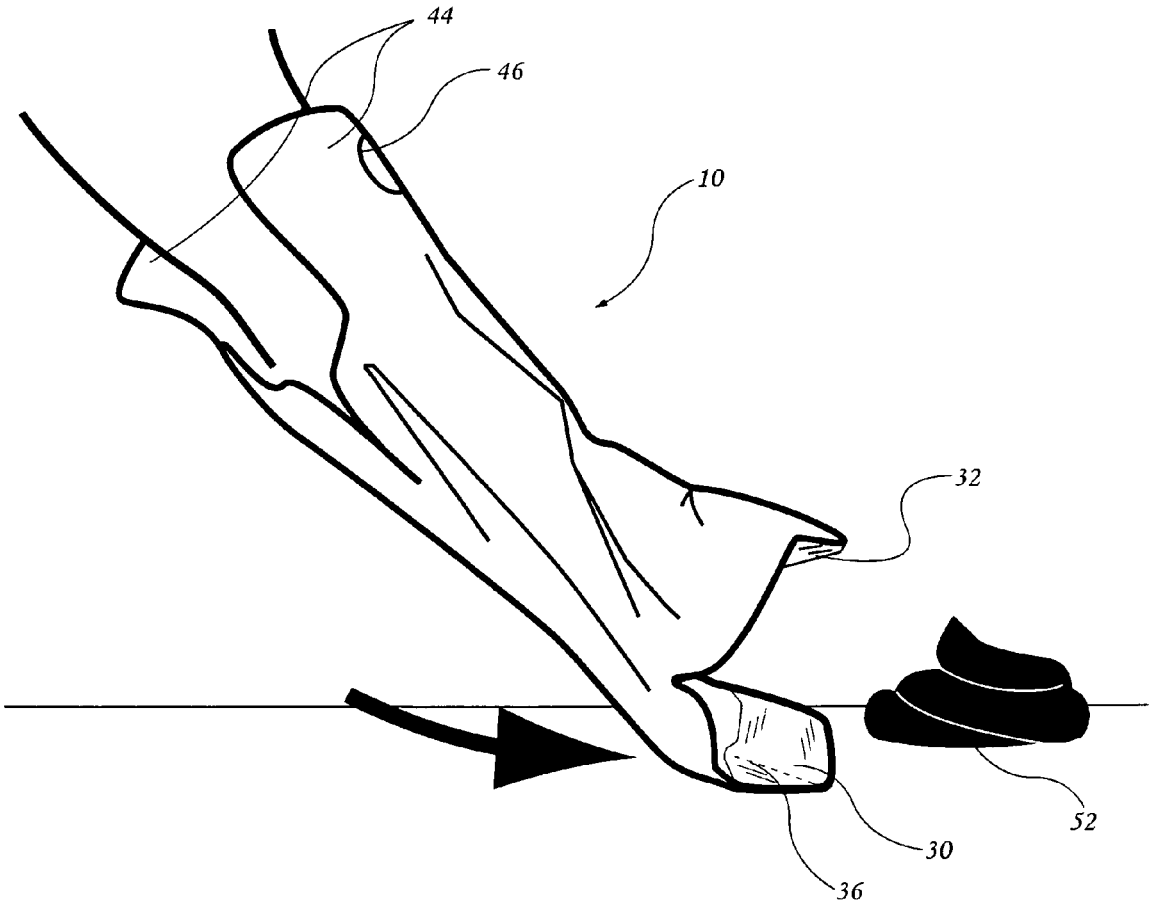

FIG. 9: A further perspective view of the present invention shows the position of the reinforced pick-up bag just before collecting the waste matter. The waste matter may be picked up with the reinforced bag in a "grab" position as illustrated, collecting from the top, or possibly scooped in a shovel position collecting from the side of the pet waste matter. FIG. 9 illustrates the use of shovel like position.

Figure 10:
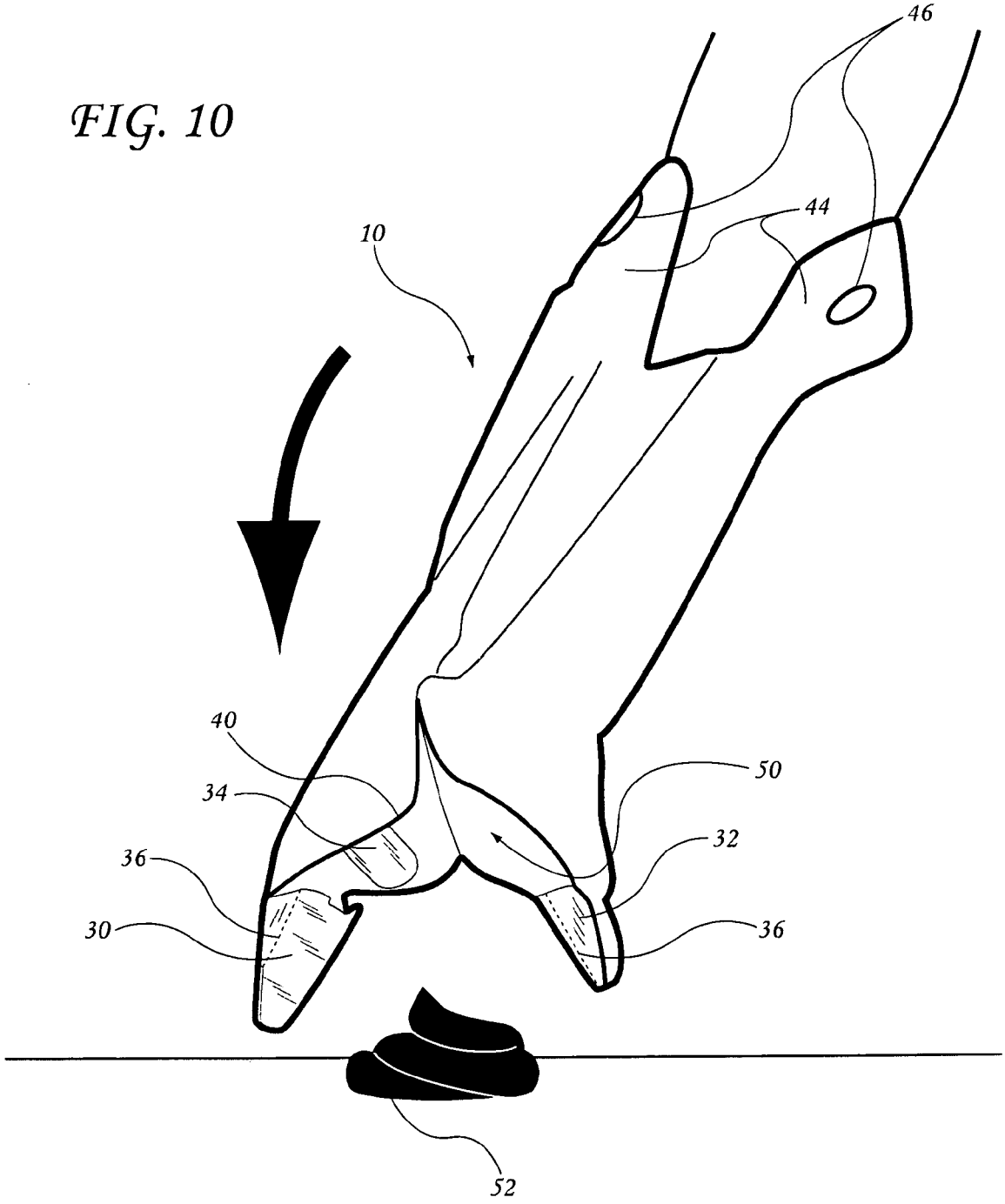

FIG. 10: A further perspective view of the present invention shows the position of the reinforced pick-up bag just before collecting the waste matter. The waste matter may be picked up with the reinforced bag in a "grab" position as illustrated, collecting from the top, or possibly scooped in a shovel position collecting from the side of the pet waste matter. FIG. 10 illustrates the use of a "grab" like position.

Figure 11:
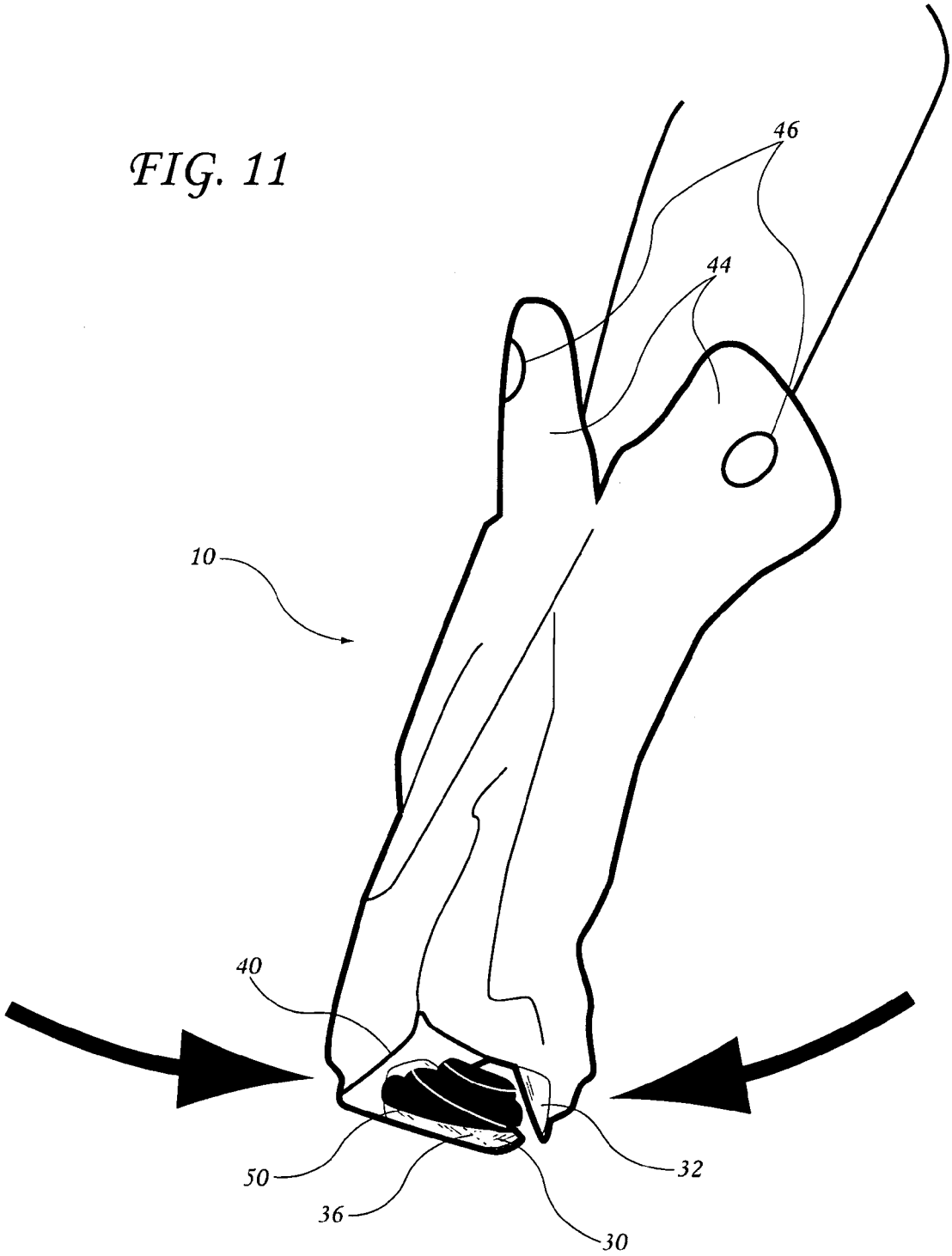

FIG. 11: Yet another perspective view of the present invention illustrates an example of finger and hand motion with the two designated finger pockets, collecting the pet waste matter into the designated inner waste matter collecting pocket.

Figure 12:
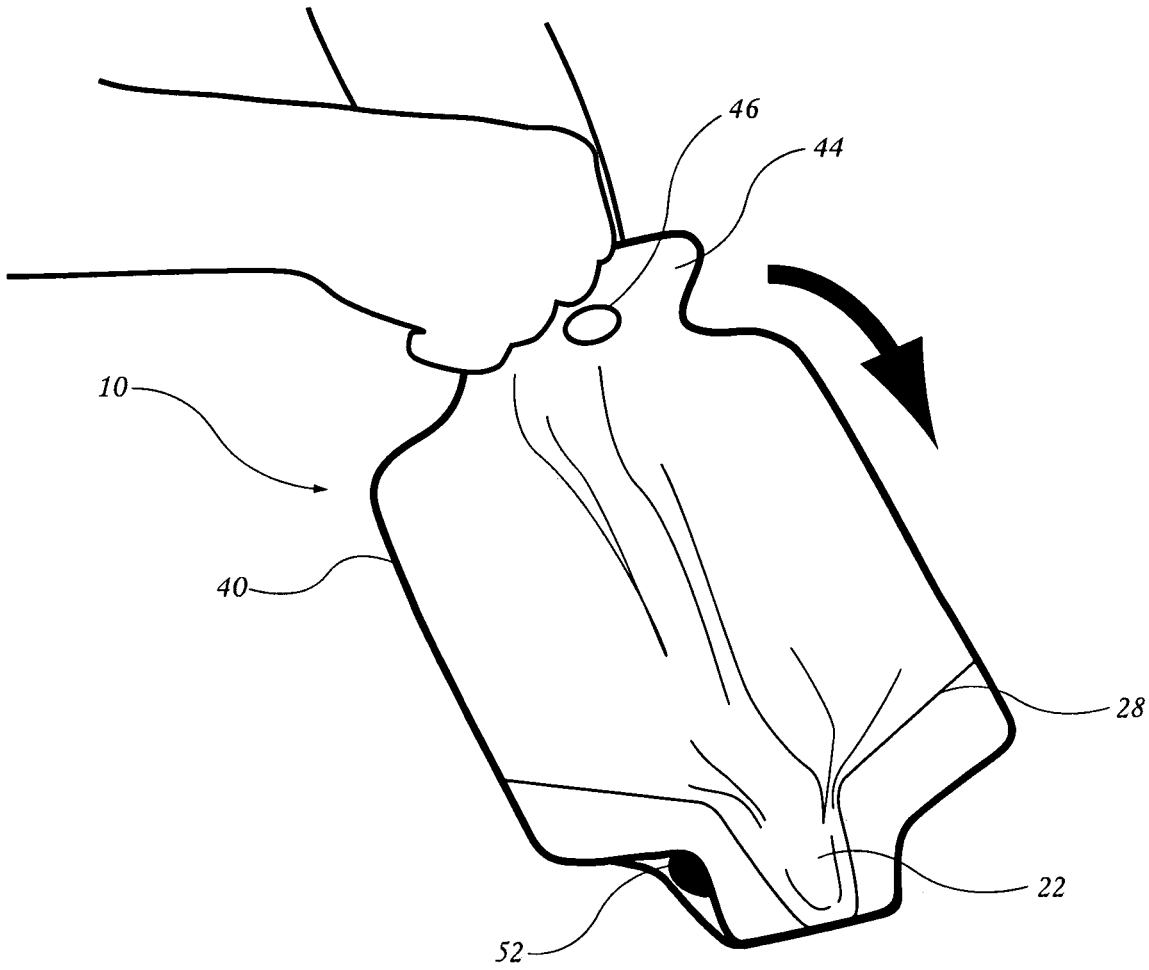

FIG. 12: A further perspective view of the present invention illustrates the moment once the user has collected the pet waste matter when he or she may uses one of the designated positioned flaps to help remove the bag from the hand in a clean and quick way.

Figure 13:
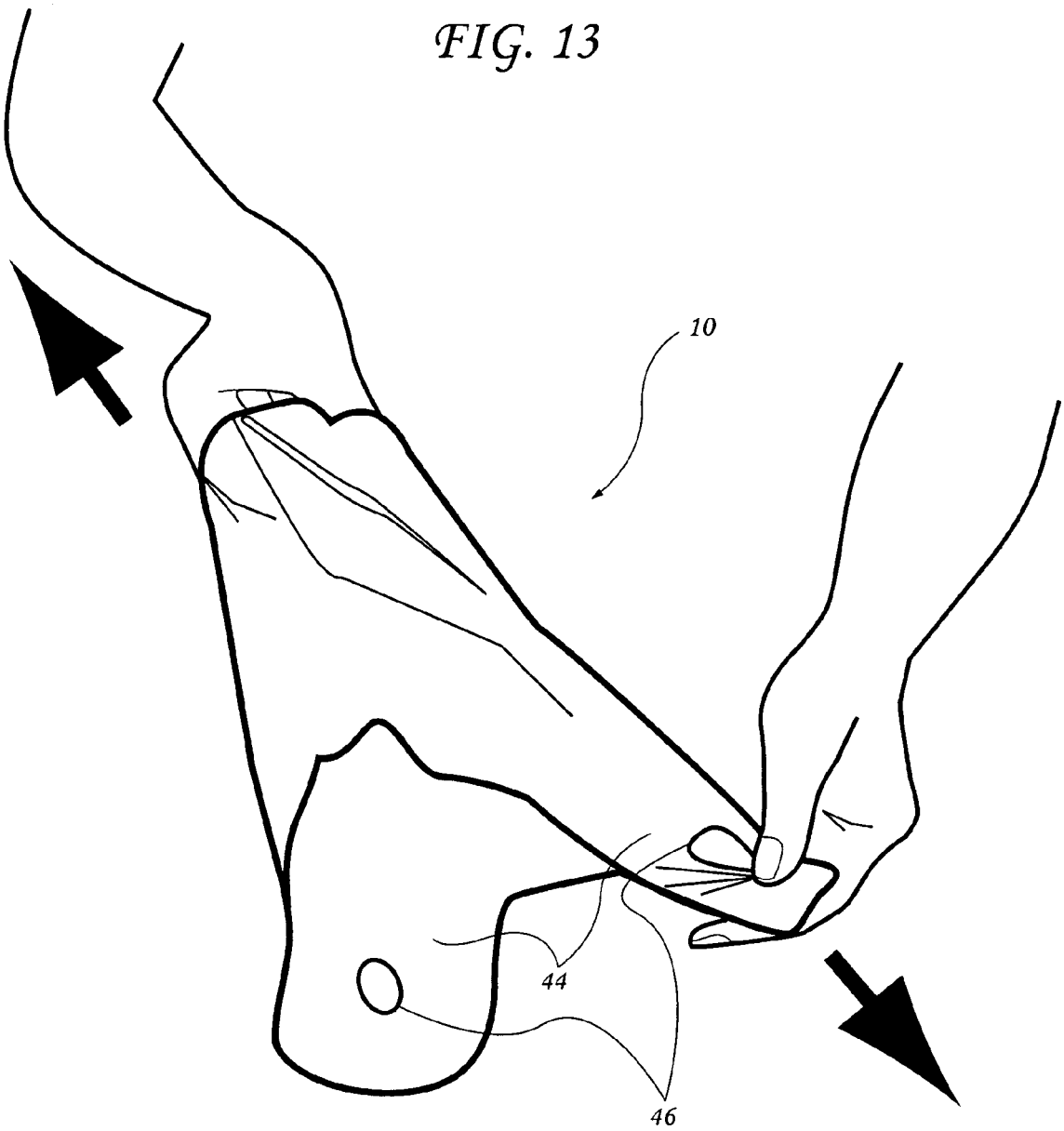

FIG. 13: Yet another perspective view of the present invention illustrates the action of continuing pulling the flap completely away from the hand, flipping the bag inside out so the former exterior surface becomes the interior surface.

Figure 14:
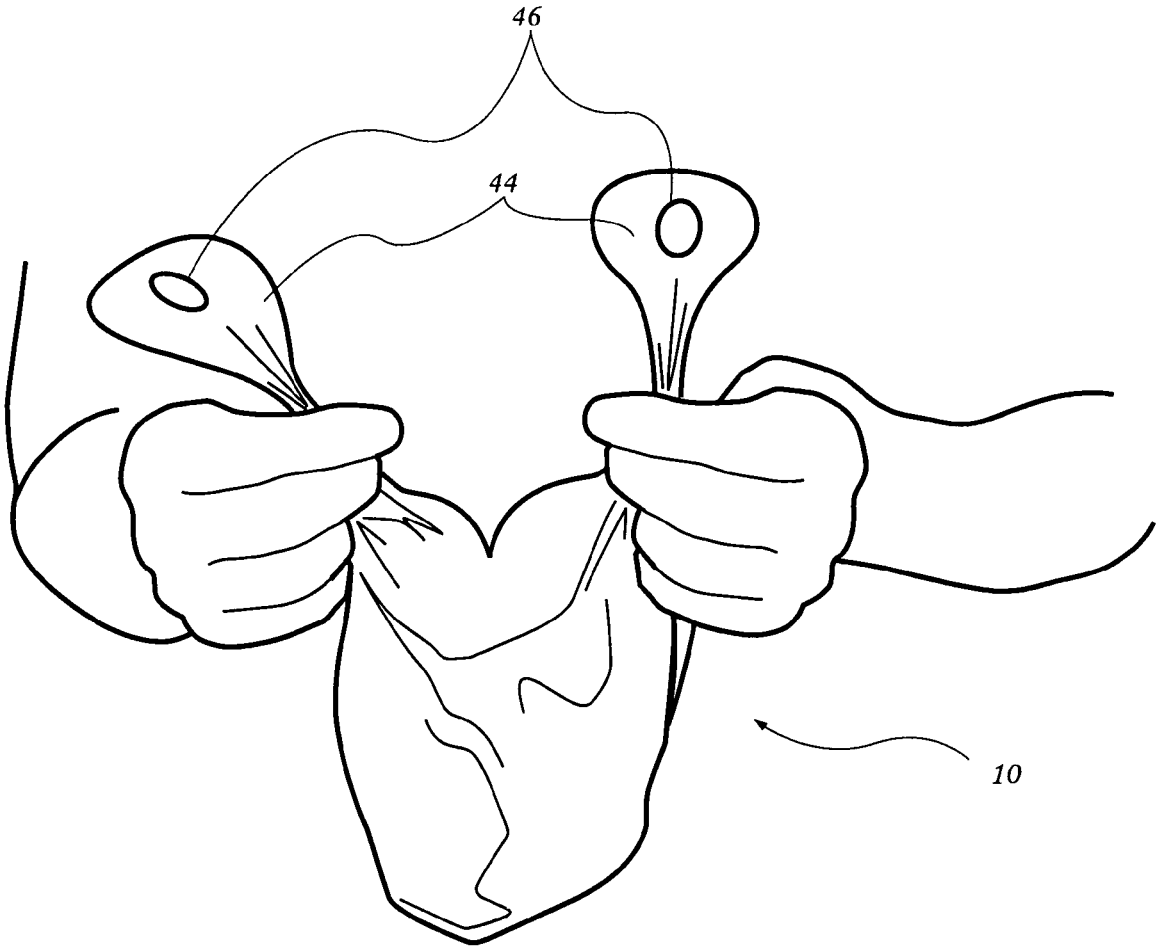

FIG. 14: Yet another perspective view of the present invention illustrates the moment of after turning the bag inside out and preparing to possibly tie a knot or two with the purposefully designed flaps for a hygienic carry, minimize smell of waste matter, minimize contact with waste matter and easy carrying and disposal.

Figure 15:
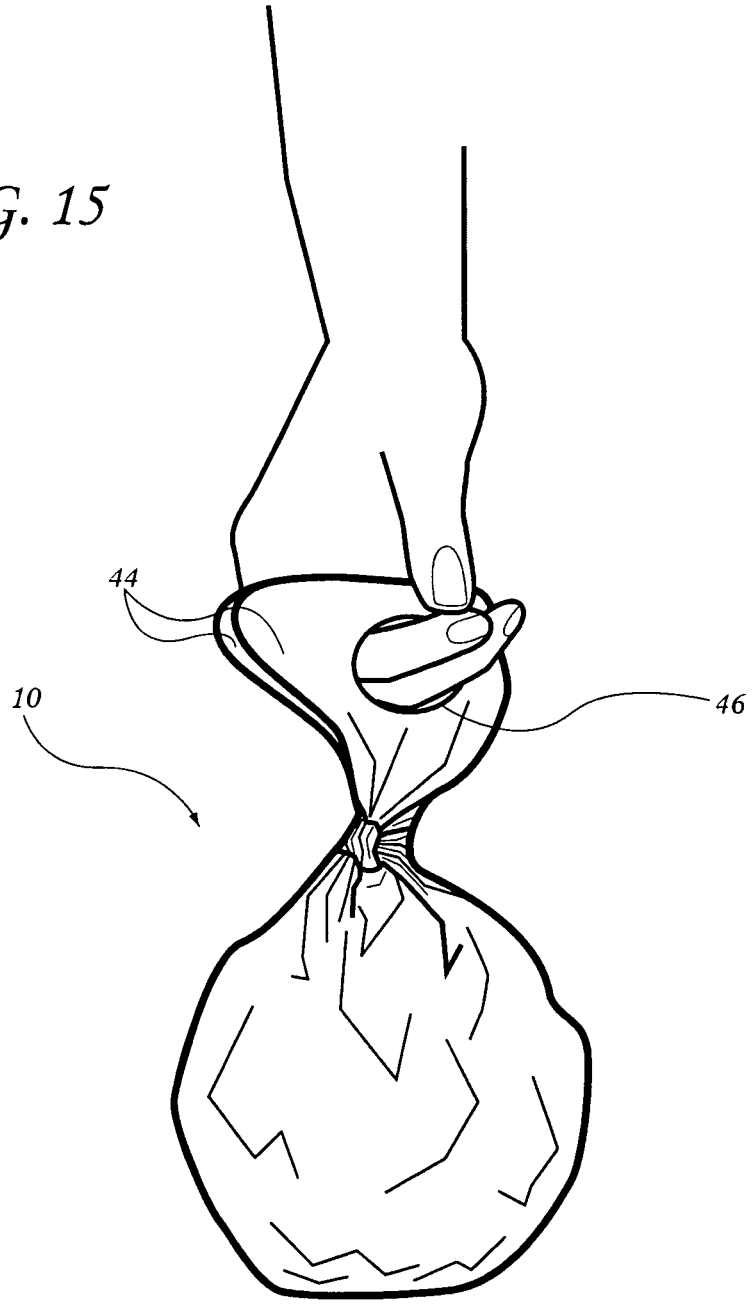

FIG. 15: Yet another perspective view of the present invention illustrates an easy to carry handle holes for an easy and hygienic and a quick and clean disposing.

Figure 16:
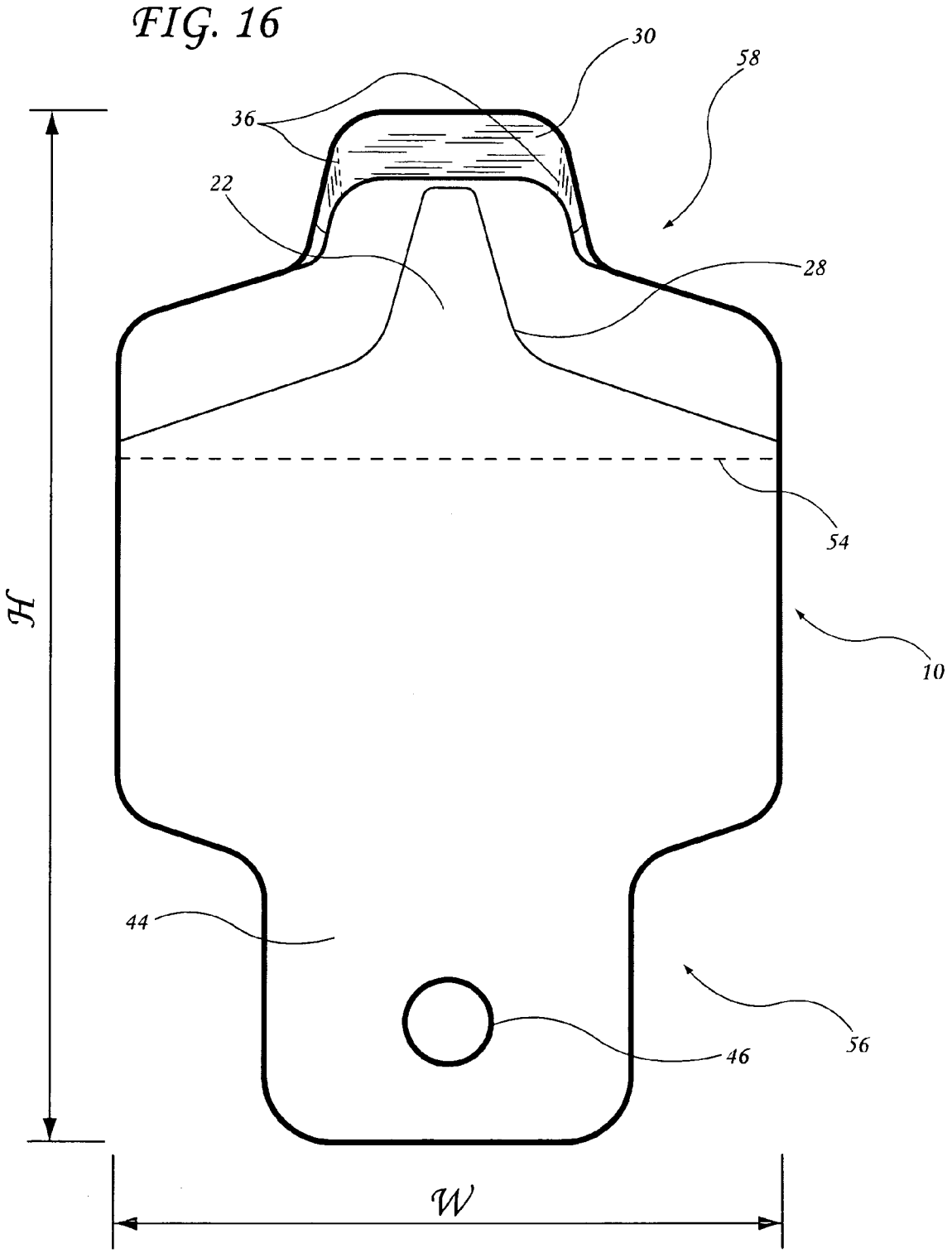

FIG. 16: A top view of the present invention illustrates the general design. It illustrates the details and location of the thumb pocket seal and reinforced member surface at the exterior face pet waste collecting matter pocket. It illustrates the location of the pull, remove and tie flaps.

Figure 17:
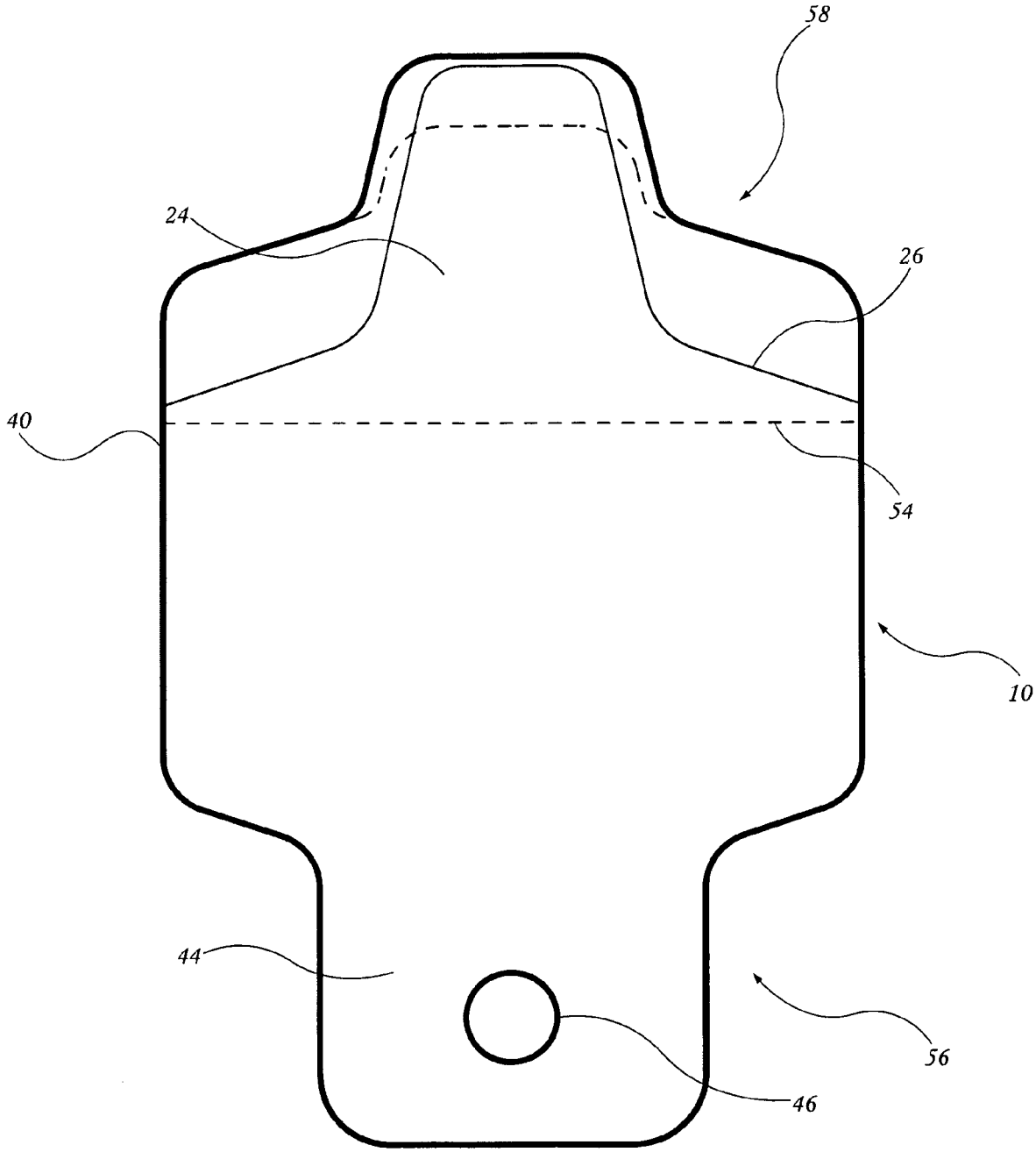

FIG. 17: A bottom view of the present invention illustrates the general design. The details and location of the four fingers pocket seal and location and the location of the pull, remove and tie flaps.

DETAILED DESCRIPTION OF THE INVENTION

Overview

Turning now descriptively to the drawings, the figures illustrate a flat packaging 20 of a number of individual pick-up bags 10, fingers pockets 22, 24, pick-up bag reinforced members 30, 32, 34, pet waste matter 52 collection pocket 50, ambidextrous use (FIG. 7.1, FIG. 7.2), pull remove and tie flaps 44 and easy to carry handles 46.

Fingers Pockets

The finger pockets 22, 24, may be constructed by the pockets' thermoplastic seal 26, 28 (FIG. 16, FIG. 17). The pockets 22, 24 may provide good hand control on the bag for a quick and effective pet waste matter 52 handling (FIG. 9, FIG. 10, FIG. 11). Reinforced members 30, 32, 34 may be applied on a portion of the exterior face of the finger pockets to increase separation between fingers and waste matter collecting pocket (FIG. 8). The finger pockets 22, 24 may be tapered to guide and ease the fingers to fit in tightly (FIG. 6, FIG. 7.1, FIG. 7.2), and may ease removal of the bag of the hand (FIG. 13). The finger pockets 22, 24 form may be positioned at the edge of the closed end 58 (FIG. 5, FIG. 17) of the pet waste collecting pocket 50 for an efficient, precise, easy and quick waste matter 52 handling (FIG. 7.1, FIG. 10, FIG. 11).

There are two finger pockets 22, 24 (FIG. 7.1, FIG. 16, FIG. 17), one pocket 22 for the thumb and second pocket 24 for the other four fingers. These two finger pockets open into a sleeve portion that starts approximately at the seal heat cut 40 and extends past the handle holes 46. The user's hand, wrist, and part of their forearm reside in the sleeve portion when the fingers are placed in the finger pockets. The operation of collecting pet waste matter may occur with the movement of the finger pocket surfaces 22, 24, 30, 32 (FIG. 10, FIG. 11). Both pockets 22, 24 may have tapered thermoplastic seal 26, 28 (FIG. 7.1) at the closed edge 58 of the pick-up bag 10 which may allow a snug finger fit for a better collecting operation. The exterior surface of the pockets may have dedicated reinforced members 30, 32, 34 (FIG. 8) to create a comprehensive barrier between the waste matter 52 and the collector's hand (FIG. 8). The pocket seal 26, 28 may be created by coupling the two different layers of plastic film by heat. The sealed seam 26, 28 guides the fingers to the correct location (FIG. 6, FIG. 7.1, FIG. 16, FIG. 17). Due to the characteristics of the reinforced members 30, 32, 34 the hand may be able to collect the pest waste matter 52 it a variety of ways, includes but not limited to a "grab" (FIG. 10, FIG. 11) collecting from the top and "scoop-shovel" collecting from the side (FIG. 9). The mentioned reinforced members 30, 32, 34 and the finger pockets 22, 24 good fit may be easily utilized and operates to collect multiple waste matter 52 pick-ups with the same pick-up bag 10 (FIG. 10, FIG. 11).

Reinforced Surface

Reinforced material is used to create a reinforced member 30, 32, 34 that may be applied on at several locations on the surface of the pet waste collecting pocket 50 (FIG. 8) to increase the stiffness of the device and minimize pet waste matter touch and feel to the hand of the waste collector and may be easily utilized to operate to collect multiple waste matter pick-ups with the same pick-up bag (FIG. 10, FIG. 11).

The reinforced members 30, 32, 34 may exist on the bags on dedicated locations at the surface of the waste matter collection compartment 50 (FIG. 8). The reinforced members 30, 32, 34 may be located on fingers pads thumb pad and hand pads (FIG. 8). The reinforced members 30, 32, 34 can be applied on the pick-up bag 10 to create a barrier and a structural reinforcement (FIG. 8). The reinforced members 30, 32, 34 may be a plastic flat surface composed of polypropylene, polyethylene terephthalate (PETE or PET), polyethylene, and polycarbonate. The reinforced members 30, 32, 34 may have dedicated pressed fold lines 36 (FIG. 8) that flex toward the user's fingers so that the pet waste collecting pocket 50 maintains its rigidity all around to provide greater mechanical control to the collected waste 52. The reinforced members 30, 32, 34 may minimize the touch and feel of the pet waste matter 52, including waste matter's heat, texture, plasticity, consistency and density (FIG. 8, FIG. 10, FIG. 11). The reinforced members 30, 32, 34 may create a clean, quick, precise and effective waste matter pick-up (FIG. 10, FIG. 11). The reinforced members 30, 32, 34 may be located on but not restricted to the location of the hand's thumb, the hand's four fingers, and the hand's pads (FIG. 8). The reinforced members 30, 32, 34 may or may not have a textured pattern for a better pet waste grip. This textured pattern can be created by embossing or imprinting directly onto the reinforced member. The reinforced members at the four fingers pad 30 and thumb 32 location may be aligned straight with at the closed edge 58 of blown film extruded bag 10, it allows the collector to pick up the pet waste 52 with much ease when the reinforced surface 30, 32 is at the edge, it's 30, 32 straight edge is parallel to the bag's straight edge at it's closed end 58 and parallel to the surface of where the pet waste 52 is on at the time of the collecting 9, 10. The reinforced member 30, 32, 34 are not restricted to any shape or size.

Pet Waste Collecting Pocket

A waste matter collecting pocket 50 (FIG. 8) may possibly be located at the close edge of the bag 58, a folded section of the bag is folded in and the film layers are coupled and sealed 26, 28, with a seal heat cut 40 that defines the form and obtain structure and strong seal (FIG. 8, FIG. 7.1, FIG. 16, FIG. 17).

The structural purpose of the sealed collection compartment 50 is to contain the collected pet waste matter 52 (FIG. 8). The waste matter collecting pocket 50 may have dedicated sections applied with reinforced members 30, 32, 34 to create minimize feel of the pet waste matter 52 (FIG. 8). The fingers pockets surface 22, 24 are integrated in the waste matter collection pocket 50 to assist in grabbing or scooping the waste matter (FIG. 9, FIG. 10, FIG. 11) into the collecting waste matter pocket 50 and may easily be used for a multiple waste matter pick-ups at the same session of operation (FIG. 10, FIG. 11). The finger pockets 22, 24 with fingers inserted may create a partly collecting pocket 50 partly glove-like handling to achieve a clean, precise, effective and easy pick-up (FIG. 10, FIG. 11). The collecting pocket 50 may be easily utilized and operate to collect multiple waste matter 52 pick-ups with the same pick-up bag 10. The depth of the collecting pocket 50 is defined by the distance from the pick-up bag bottom closed edge 58 to the max depth of the collecting pocket 54 (FIG. 17). The total depth of the collecting pocket 50 is not limited to any size.

Pull Remove and Tie and Flaps

Flaps 44 are located at the open edge of the pick-up bag 56 (FIG. 16, FIG. 17) and may be used for pulling the bag for a good fingers fit once the hand is inserted (FIG. 6), removing pick-up bag from hand, turning the bag inside out (FIG. 12, FIG. 13), and tying and closing open edge 56 for clean, easy and carrying and handling (FIG. 14, FIG. 15)

The dedicated designed flaps 44 are located at the open edge 56 of the bag 10 (FIG. 5) above the thumb and finger pockets 22, 24 (FIG. 16, FIG. 17). The dedicated flaps 44 may be used for an easy designated pull (FIG. 6), remove and tie operation (FIG. 13, FIG. 14, FIG. 15). Pulling the flaps 44 assist the fingers in reaching the dedicated finger pockets 22, 24 after inserting the hand into the bag's opening (FIG. 6, FIG. 7.1). Yet another important feature of the flaps 44 may be removing the bag 10 in a clean and quick way by pulling one of the flaps 44 away from the hand (FIG. 12, FIG. 13), flipping the bag 10 inside out (FIG. 13). This may secures the waste matter 52 inside the bag (FIG. 13, FIG. 14, FIG. 15). Yet another feature of the flaps 44 may be use to ties the two dedicated flaps 44 together (FIG. 14, FIG. 15), which when tied together may isolate the waste matter from possible touch of hand, messy handling and smells (FIG. 15). The dedicated tied flaps 44 may limit the waste matter exposure and provide an easy, clean and fast deposal (FIG. 13, FIG. 14, FIG. 15).

Besides the location indicated above the flaps 44 may be located at different location along the open edge of the bag 56.

Dedicated Handle Holes

The handle holes 46 may be located the opened edge 56 of the clean-up bag 10 and may be use to carry the pick-up bag 10 to disposal (FIG. 15).

Ambidextrous Use

The pick-up bag 10 may be used with the right or left hand with the same level of comfort and effectiveness (FIG. 7.1, FIG. 7.2).

The pick-up bag 10 and its finger pockets 22, 24 may be structured with a symmetric axe to obtain equal operation comfort and effectiveness on both hands (FIG. 7.1, FIG. 7.2, FIG. 16, FIG. 17).

Packaging

The pick-up bags 10 may be but not restricted to a flat folded bag in a packaging 20 which contain a number of bags and provides a quick and easy pull-out independent bags one after the other (FIG. 1, FIG. 2). The pick-up bag's packaging in some embodiments is portable and pocket size 20 and it might be used in a dedicated dispenser with different carrying futures to maximize comfort at this Dog walking activity. In other embodiments packaging of bags may also contain different numbers of bags 10 flat and unfolded for different layout of packaging and for home and public dispensers.

Blown Film Bag

The pick-up bag 10 may be a blown film extrusion manufacturing and may be manufacture out of but not limited to materials as polyethylene, biodegradable polyphone films, hydrodegradable films, degradable plastics base films, oxo-biodegradable polyethylene, starch base films, bio-based films, polylactic acid films, biodegradable films and compostable films (FIG. 16, FIG. 17). The material composites of the bag may be scented with fragrant or unscented. The pick-up bag 10 may be fabricated as a high density blown film extrusion bag (FIG. 13, FIG. 14). The pick-up bag 10 may be fabricated as a low density blown film extrusion bag (FIG. 13, FIG. 14). The bag 10 may be constructed with thermoplastic sealed seam at the closed end of the bag 58, at the finger pockets 26, 28, and cut opened at the open end of the bag 56.

The total height of the pick-up bag 10 will not be restricted to any height and may be the total of 38.5 centimeters (FIG. 16, FIG. 17). The total width of the pick-up bag 10 will not be restricted to any width and may be the total of 24 centimeters.

Connections of Main Elements and Sub-Elements of Invention

All pockets 22, 24, 50 connections may possibly be coupled and joined with heat (FIG. 7.1, FIG. 8). The reinforced members 30, 32, 34 may be connected to the clean-up bags 10 with adhesives (FIG. 8).

Methods of Manufacturing

Blown film extrusion is creating a tubular film; the tubular film is folded flat laying one film layer on top of the other; the film may be cut at one layer and spread flat to one layer; the graphic applications and reinforced members 30, 32, 34 may be attached with adhesives to the film; the material film may be folded to create approximately the same width of two layers of film one top of each other; a collecting pocket 50 may be formed by pushing one layer of film at the closed end of the film towards the opened end that may create four layers of film that form an exterior pocket at the closed end; at the exterior pocket two top layers may be coupled with heat 26 for the fingers pocket 24 and the edge 58 of that coupled surface possibly fused and cut to a dedicated form; at the exterior pocket the two bottom layers may be coupled with heat 28 for the thumb pocket 28 and the edge of that coupled surface possibly fused and cut to a dedicated form; at the opened edge a die cut operation may cut out an opening through the two layers that possibly be used as the handles 44 of the pick-up bag; the opened edged 56 may be cut and form the opened edge and the dedicated flaps; the sides of the bag is coupled with heat and cut this closed edge and creates an independent bag 10.

Operation of a Specific Embodiment

The pick-up bag 10 may possibly be contained in a portable flat packaging 20 (FIG. 1, FIG. 2). The pick-up bag 10 may be pulled out of its packaging or handed as an individually (FIG. 2). One hand may used to hold the bag 10 from the opened edge 56 (FIG. 3, FIG. 4) while the other hand may be inserted into the bag 10 (FIG. 4, FIG. 5). The hand may be inserted and fitted in using its pockets seams (FIG. 6, FIG. 7.1, FIG. 7.2) as a guide to the snug-fit pockets 22, 24 position (FIG. 7.1). Thumb may be inserted into the thumb pocket 22 (FIG. 6, FIG. 7.1, FIG. 7.2) and four fingers into four fingers pocket 24 (FIG. 5.1, FIG. 5.2). The hand that is inserted into the pick-up bag 10 may be guided to place by the seams 26, 28 (FIG. 6, FIG. 7.1) while the other hand helps by pulling at one of the pull flaps 44 (FIG. 6).

The fingers are positioned at the dedicated location (FIG. 7.1) and the collector may be reaching down to collect the waste matter (FIG. 9, FIG. 10). The waste matter pick-up bag 10 may be an ambidextrous bag 10 for the use by either the right hand (FIG. 7.1) or the left hand (FIG. 7.2). The hand may be creating a "grab" action by bringing together the reinforced members 30, 32 are controlled by the thumb with reinforced surface 32 to the reinforced surface of the four fingers 32 (FIG. 10, FIG. 11). The collector may collect the waste matter 52 (FIG. 11) into the waste matter collecting pocket 50 (FIG. 11). There are different possible ways to collect the waste matter. Another possible way may be to use the reinforced members controlled by the four fingers to "scoop" the waste matter from the side (FIG. 9) into the waste matter collecting compartment 50. The waste matter 52 may be now contained in the waste matter collecting pocket 50 (FIG. 11, FIG. 12). The collector may removes the bag 10 from his/her hands by holding with his free hand one of the flaps 44 (FIG. 12, FIG. 13) and pulling it away from him/her and flipping the pick-up bag 10 inside out (FIG. 12, FIG. 13). Doe to this operation the waste matter 52 may be securely contained in the interior of the flipped bag 10 (FIG. 13, FIG. 14). With the waste matter 52 contained in the flipped bag 10 (FIG. 12, FIG. 13) the collector may tie the bag tight (FIG. 14, FIG. 15) using the dedicated flaps 44 to reduce smell, contact with waste matter 52. The pick-up bag 10 may be carried to disposal by its flaps 44 by its dedicated handle holes (FIG. 15).

Sample Implementation of Invention

In a method of implementing the invention, the length of the device on the side with the four finger pocket is 38 centimeters and the length of the device on the side with the thumb pocket is 35 centimeters. The width of the device at its largest is 24.5 centimeters.

Inside the pet waste collecting pocket, the depth of the pet waste collecting pocket 50 is 12.5 centimeters. The reinforced member attached to the finger pocket for the four fingers 30 is 10 centimeters in length and 5.5 centimeters in height. The reinforced member attached to the finger pocket for the thumb is 10 centimeters in length and 4 centimeters in height. The reinforced member at the hand 34 is 4 centimeters squared of surface area and 2.5 centimeters in height. The reinforced member 30, 32, 34 is made of card stock with a thickness of 0.2-2 millimeters.

At the distil end of the thumb pocket, the approximately straight edge is 2 centimeters wide. At the distil end of the pocket for the four fingers, the approximately straight edge is 5 centimeters wide. These two straight edges at the finger pockets are centered with respect to the width of the device.

What has been described and illustrated herein may be a specific embodiment of the invention along with some of its variations. The terms, descriptions, and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

The invention claimed is:

1. A glove comprising:

a first pocket designed to receive four fingers of a user;

a second pocket designed to receive a thumb of the user, wherein the first and second pocket meet at a straight fold line, a first length of an exterior of the first pocket is from a tip of the first pocket to the fold line, a second length of an exterior of the second pocket is from a tip of the second pocket to the fold line, and the second pocket is shaped differently from the first pocket to accommodate fewer fingers than the first pocket;

a sleeve portion designed to cover a hand of the user, wherein the first and second pockets open to the sleeve portion;

a first reinforcing member, coupled to a first exterior surface of the first pocket, wherein the first reinforcing member comprises at least a portion having a first straight edge, the first straight edge is positioned at the tip of the first pocket, and the first straight edge is approximately parallel to the straight fold line;

a second reinforcing member, coupled to a second exterior surface of the second pocket, wherein the second reinforcing member comprises at least a portion having a second straight edge, and the second straight edge has a length greater a width of the second pocket;

the first and second reinforcing members face each other and are staggered with respect to each other such that when first and second pockets are folded flat against each other, the second straight edge extends across a face of the first reinforcing member while the first straight edge is positioned away from the second straight edge in a direction distal from an opening of the glove, and the first and second straight edges are approximately parallel to each other;

a third reinforcing member, coupled to the first exterior surface of the first pocket; and a fourth reinforcing member, coupled to the first exterior surface of the first pocket.

2. The glove of claim 1 wherein the first pocket, second pocket, and sleeve portion are made using a blown film extrusion.

3. The glove of claim 2 wherein the first reinforcing member and second reinforcing member comprise a rigid material having greater stiffness than the blown film extrusion.

4. The glove of claim 2 wherein the first reinforcing member and second reinforcing member comprise card stock.

5. The glove of claim 4 wherein the card stock comprises embossed, texture patterning.

6. The glove of claim 4 wherein the second straight edge of the second reinforcing member is positioned at a distal end of the second pocket.

7. The glove of claim 1 a distance from a tip of the first pocket to a bottom of the first pocket is at least 10 millimeters.

8. The glove of claim 1 wherein the first pocket, second pocket, and sleeve portion are made using a blown film extrusion, the first reinforcing member and second reinforcing member comprise a rigid material having greater stiffness than the blown film extrusion, and first and second openings, positioned at a proximal end of the sleeve portion.

9. The glove of claim 1 wherein the first straight edge of the first reinforcing member has a thickness of about 0.2 millimeters to about 1 millimeter.

10. The glove of claim 1 wherein a width of the sleeve portion is greater than a width of the first pocket.

11. The glove of claim 1 wherein the sleeve portion comprises a first sleeve portion having a first width greater than that of a second sleeve portion, the second sleeve portion being proximal to the first sleeve portion.

12. The glove of claim 11 wherein the second pocket is centered or approximately centered laterally below the first pocket.

13. The glove of claim 11 wherein the glove is made from plastic material to which scenting has been applied.

14. The glove of claim 1 wherein the second straight edge is positioned at the tip of the second pocket, and the second straight edge is approximately parallel to the straight fold line.

15. The glove of claim 1 wherein the second straight edge extends from a first point at one side of the second pocket to a second point at another side of the pocket, an axis line of the second pocket extends perpendicularly to the second straight edge, and the first and second points are about equidistant to this axis line.

16. The glove of the claim 1 wherein the first reinforcing member comprises a first fold line on one side of the first pocket and a second fold line on an opposite side of the first pocket.

17. A device comprising:

a plastic bag, comprising an interior surface and exterior surface, and a first portion adapted to receive four fingers of a user and second portion shaped differently from the first portion and adapted to receive a thumb of the user, wherein the first and second portions of the plastic bag provide a moisture-proof barrier for the users' fingers and thumb, a first stiffening material, comprising a first cardboard piece, is coupled to an exterior surface of the first portion, a second stiffening material, comprising a second cardboard piece, is coupled to an exterior surface of the second portion, the first and second stiffening materials are separate cardboard pieces, whereby the first and second stiffening materials are oriented with respect to each other to facilitate scooping of animal waste material, and the first and second stiffening materials reduce heat conduction of the animal waste material to the fingers and thumb compared to using a plastic bag without the first and second stiffening materials, a third stiffening material, comprising a third cardboard piece, is coupled to the exterior surface of the first portion, a fourth stiffening material, comprising a fourth cardboard piece, is coupled to the exterior surface of the first portion, the third and fourth stiffening materials are separate cardboard pieces positioned between the between first and second stiffening materials, whereby the third and fourth stiffening materials reduce heat conduction of the animal waste material to a palm of the user compared to using a plastic bag without the third and fourth stiffening materials.

18. The device of claim 17 wherein the plastic bag comprises a flexible material such that after scooping animal waste material, the plastic bag can be flipped over so the exterior surface becomes an interior surface of the flipped plastic bag and the animal waste material and first and second stiffening materials are inside the flipped plastic bag.

19. The device of claim 17 wherein the first stiffening material comprises a first straight edge, the second stiffening material comprises a second straight edge, and the first and second straight edges are approximately parallel to each other, and also approximately parallel to a straight fold line where the first and second portions meet, and the first and second stiffening materials are staggered with respect to each other such that when first and second portions are folded against each other, the first straight edge is positioned away from the second straight edge in a direction distal from an opening of the plastic bag.

20. The device of claim 17 wherein the first and second stiffening materials comprise embossed, texture patterning.

* * * * *